US009183796B2

(12) United States Patent
Lin et al.

(10) Patent No.: US 9,183,796 B2
(45) Date of Patent: Nov. 10, 2015

(54) IMAGE SIGNAL PROCESSING METHOD

(75) Inventors: Hui-Feng Lin, Hsin-Chu (TW); Sheng-Wen Cheng, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 359 days.

(21) Appl. No.: 13/610,910

(22) Filed: Sep. 12, 2012

(65) Prior Publication Data

US 2014/0022271 A1 Jan. 23, 2014

(30) Foreign Application Priority Data

Jul. 19, 2012 (TW) ..... 101126005 A

(51) Int. Cl.

| | |
|---|---|
| ***G09G 3/36*** | (2006.01) |
| ***G09G 5/00*** | (2006.01) |
| ***G09G 5/02*** | (2006.01) |
| ***G09G 5/10*** | (2006.01) |

(52) U.S. Cl.

CPC .. *G09G 3/36* (2013.01); *G09G 5/02* (2013.01); *G09G 5/10* (2013.01); *G09G 2300/0452* (2013.01); *G09G 2320/0242* (2013.01); *G09G 2320/0276* (2013.01); *G09G 2320/0646* (2013.01); *G09G 2340/06* (2013.01); *G09G 2360/16* (2013.01)

(58) Field of Classification Search

CPC ..... G09G 3/3607
USPC ..... 345/581, 589–592, 606, 613, 690–694, 345/617, 102, 87, 84, 55
See application file for complete search history.

(56) References Cited

U.S. PATENT DOCUMENTS

| | | | | |
|---|---|---|---|---|
| 7,486,304 | B2 | 2/2009 | Bergquist | |
| 2009/0092325 | A1 * | 4/2009 | Brown Elliott et al. | G09G 3/20 382/232 |
| 2009/0174638 | A1 * | 7/2009 | Brown Elliott et al. | G02F 1/133621 345/88 |
| 2009/0207182 | A1 * | 8/2009 | Takada et al. | G09G 3/3406 345/589 |
| 2011/0141077 | A1 * | 6/2011 | Cho et al. | G09G 3/3426 345/207 |
| 2011/0292071 | A1 * | 12/2011 | Kwon et al. | G09G 3/3233 345/603 |

* cited by examiner

*Primary Examiner* — Yuwen Pan
*Assistant Examiner* — Zhitong Chen
(74) *Attorney, Agent, or Firm* — Winston Hsu; Scott Margo

(57) ABSTRACT

Provide a set of first RGB (red, green, blue) brightness levels of a set of pixels in a display panel. Generate a set of saturation levels according to the set of first RGB brightness levels. Generate a set of mapping ratios according to the set of saturation levels and the set of first RGB brightness levels. Generate a set of second RGB brightness levels according to the set of first RGB brightness levels and a minimum mapping ratio of the set of mapping ratios. Generate a set of RGBW (red, green, blue, white) brightness levels according to the set of second RGB brightness levels and a set of brightness levels of white sub-pixels of the set of RGBW brightness levels. And convert the set of RGBW brightness levels to generate a set of RGBW gray levels of the set of pixels.

17 Claims, 6 Drawing Sheets

IMAGE SIGNAL PROCESSING METHOD

CROSS-REFERENCE TO RELATED APPLICATIONS

This application claims priority to Taiwan Patent Application No. 101126005, filed Jul. 19, 2012, now Taiwan Patent No. 1469082 and included herein by reference in its entirety.

BACKGROUND OF THE INVENTION

1. Field of the Invention

The present invention is related an image signal processing method, and more particularly to a method of converting RGB gray levels to RGBW gray levels.

2. Description of the Prior Art

With the advancement of display panel technologies, liquid crystal display (LCD) panels are widely used in portable devices such as laptops, tablet computers, and smart phones. In general, power consumption of the portable devices should be low so that the portable devices may operate over a long period of time without being charged. However, due to RGB (red, green, blue) LCD panels having low light penetration rate such that only 5~10% of light intensity from backlight penetrates panels, energy used for illuminating panels is not fully utilized. Thus pixels should be re-designed to increase light penetration rate so as to utilize energy more efficiently and reduce power consumption of panels.

In contrast, RGBW (red, green, blue, white) LCD panels have higher light penetration rate and lower power consumption because white sub-pixels having higher light penetration rate are introduced into pixels. However, due to each sub-pixel (respectively being red, green, blue, white) of RGBW LCD panels occupying a smaller area than that of each sub-pixel of RGB LCD panels, images displayed on RGBW LCD panels are darker when the images are single colored (saturated color), and brightness may be too bright when RGBW LCD panels display all white images. Thus image quality of RGBW LCD panels may be poorer than RGB LCD panels.

SUMMARY OF THE INVENTION

An embodiment of the present invention discloses an image processing method. The image processing method comprises providing a set of first RGB brightness levels of a set of pixels in a display panel. A set of saturation levels is generated according to the set of first RGB brightness levels. A set of mapping ratios is then generated according to the set of saturation levels and the set of first RGB brightness levels. A set of second RGB brightness levels is generated according to the set of first RGB brightness levels and a minimum mapping ratio of the set of mapping ratios and a set of brightness levels of white sub-pixels, where each brightness level of white sub-pixel is generated according to a minimum second RGB brightness level of second RGB brightness levels of each pixel is generated. A set of RGBW brightness levels is generated according to the set of second RGB brightness levels and the set of brightness levels of white sub-pixels. The set of RGBW brightness levels is converted to generate a set of RGBW gray levels of the set of pixels.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
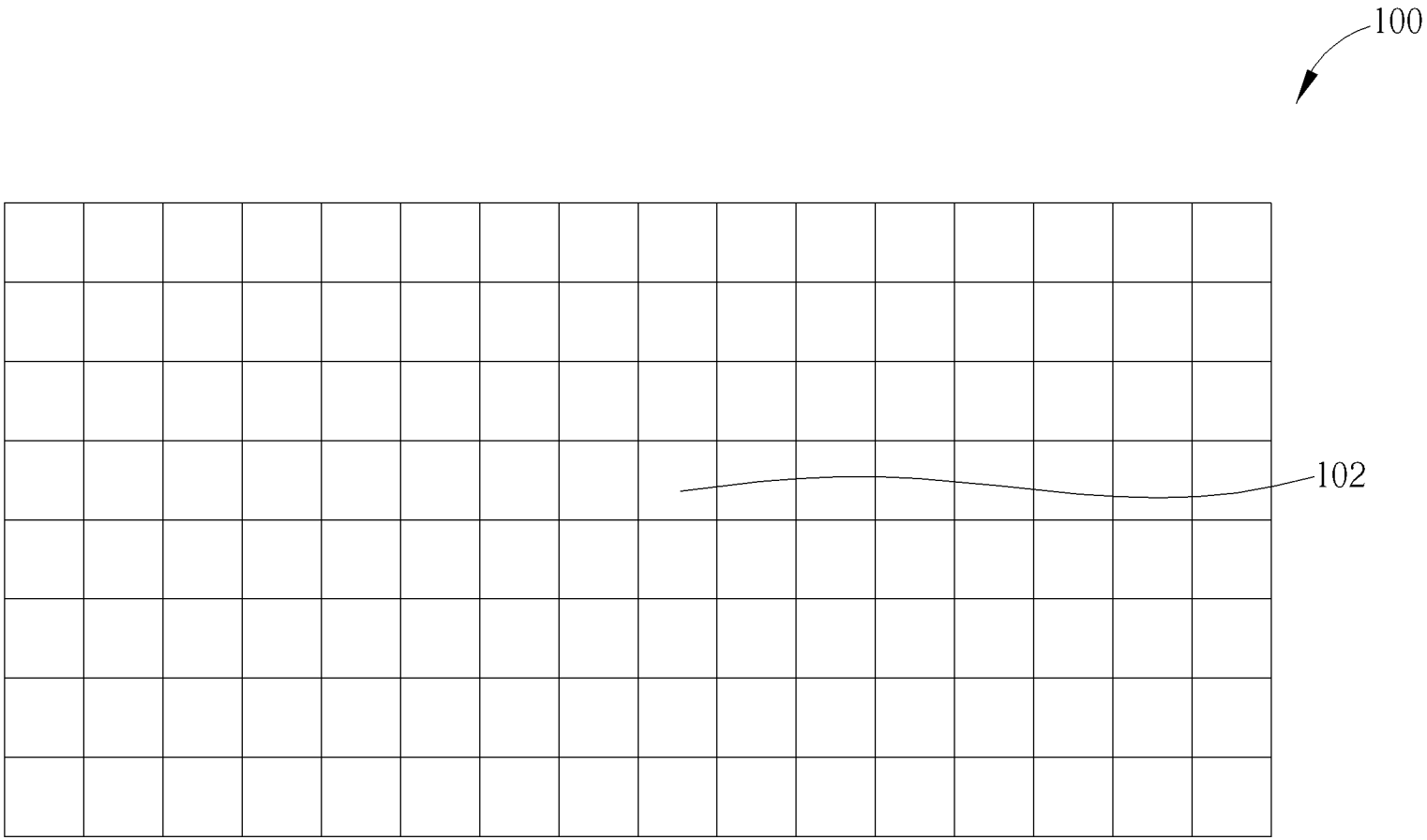
FIG. 1 is a diagram illustrating a display panel having a plurality of dynamic backlight sectors.
Figure 2:
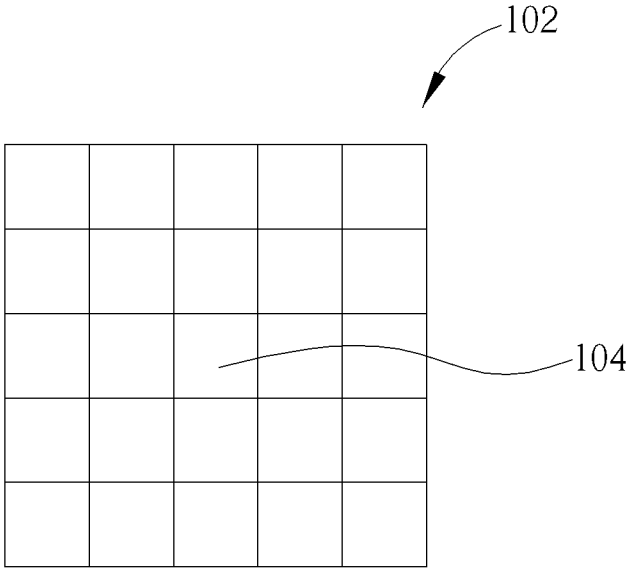
FIG. 2 is a diagram illustrating a dynamic backlight sector.

FIG. 1 is a diagram illustrating a display panel 100 having a plurality of dynamic backlight sectors 102. The display panel 100 includes 16 columns and 8 rows, totaling 128 dynamic backlight sectors 102. FIG. 2 is a diagram illustrating a dynamic backlight sector 102. The dynamic backlight sector 102 may include N pixels 104. For example, if resolution of the display panel 100 is 1920*1080, N will be the resolution divided by 16 columns and 8 rows, which is (1920*1080)/(16*8)=16200. In FIG. 2 of the present invention, N is equal to 25 so that the dynamic backlight sector 102 includes 25 pixels 104. Each pixel 104 may include four sub-pixels. The four sub-pixels are respectively red, blue, green, and white sub-pixels. The method of the present invention may be adapted to display panels having any number of dynamic backlight sectors 102 and pixels 104, and having any kind of sub-pixel layouts.

Figure 3:
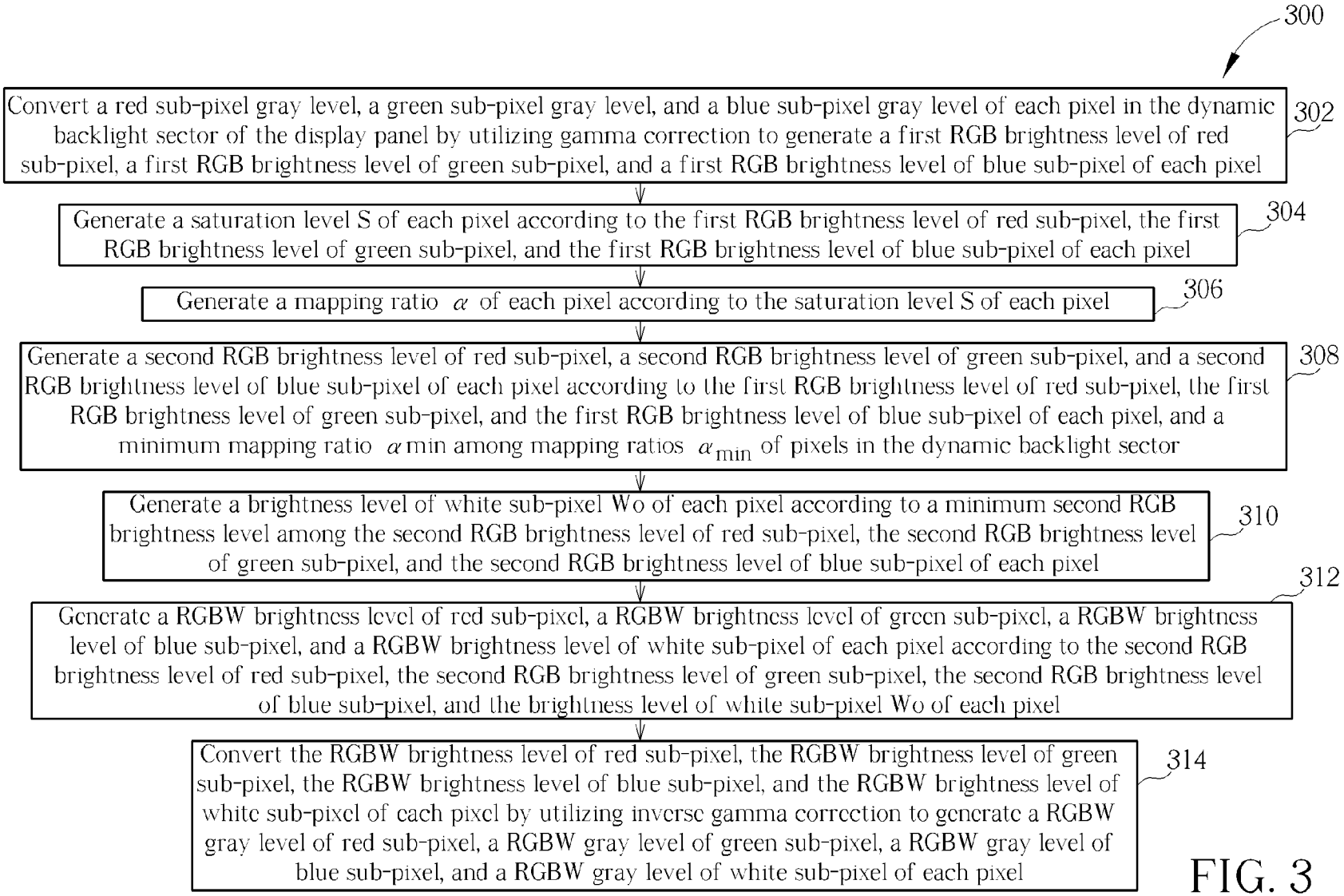
FIG. 3 is a flowchart illustrating an image processing method according to an embodiment of the present invention.

FIG. 3 is a flowchart illustrating an image processing method 300 according to an embodiment of the present invention. Please refer to FIG. 3 in conjunction with FIG. 1 and FIG. 2. The method 300 is used to convert RGB (red, green, blue) signals of pixels 104 to RGBW (red, green, blue, white) signals of pixels 104 involving backlight intensity of each dynamic backlight sector 102 in the conversion so as to achieve better quality for displaying RGBW signals of pixels 104 in each dynamic backlight sector 102. Back-light duty cycle (BL duty) is used for representing backlight intensity in all embodiments of the present invention. BL duty ranges from 0% to 100% and is proportional to backlight intensity. Gray level ranges from 0 to 255. Description of the method 300 will be focused on one dynamic backlight sector 102 of the dynamic backlight sectors 102 for brevity and other dynamic backlight sectors 102 apply the same principles as the dynamic backlight sector 102. The method 300 may include the following steps.

Step 302: Convert a red sub-pixel gray level, a green sub-pixel gray level, and a blue sub-pixel gray level of each pixel 104 in the dynamic backlight sector 102 of the display panel 100 by utilizing gamma correction to generate a first RGB brightness level of red sub-pixel, a first RGB brightness level of green sub-pixel, and a first RGB brightness level of blue sub-pixel of each pixel 104.

Step 304: Generate a saturation level S of each pixel 104 according to the first RGB brightness level of red sub-pixel, the first RGB brightness level of green sub-pixel, and the first RGB brightness level of blue sub-pixel of each pixel 104.

Step 306: Generate a mapping ratio $\alpha$ of each pixel 104 according to the saturation level S of each pixel 104.

Step 308: Generate a second RGB brightness level of red sub-pixel, a second RGB brightness level of green sub-pixel, and a second RGB brightness level of blue sub-pixel of each pixel 104 according to the first RGB brightness level of red sub-pixel, the first RGB brightness level of green sub-pixel, and the first RGB brightness level of blue sub-pixel of each pixel 104, and a minimum mapping ratio $\alpha_{min}$ among mapping ratios $\alpha$ of pixels 104 in the dynamic backlight sector 102.

Step 310: Generate a brightness level of white sub-pixel Wo of each pixel 104 according to a minimum second RGB brightness level among the second RGB brightness level of red sub-pixel, the second RGB brightness level of green sub-pixel, and the second RGB brightness level of blue sub-pixel of each pixel 104.

Step 312: Generate a RGBW brightness level of red sub-pixel, a RGBW brightness level of green sub-pixel, a RGBW brightness level of blue sub-pixel, and a RGBW brightness level of white sub-pixel of each pixel 104 according to the second RGB brightness level of red sub-pixel, the second RGB brightness level of green sub-pixel, the second RGB brightness level of blue sub-pixel, and the brightness level of white sub-pixel Wo of each pixel 104.

Step 314: Convert the RGBW brightness level of red sub-pixel, the RGBW brightness level of green sub-pixel, the RGBW brightness level of blue sub-pixel, and the RGBW brightness level of white sub-pixel of each pixel 104 by utilizing inverse gamma correction to generate a RGBW gray level of red sub-pixel, a RGBW gray level of green sub-pixel, a RGBW gray level of blue sub-pixel, and a RGBW gray level of white sub-pixel of each pixel 104.

For example, a first pixel P1 of the 25 pixels in the dynamic backlight sector 102 has a red sub-pixel gray level Gr=255, a green sub-pixel gray level Gg=0, and a blue sub-pixel gray level Gb=0; a second pixel P2 of the 25 pixels in the dynamic backlight sector 102 has a red sub-pixel gray level Gr=255, a green sub-pixel gray level Gg=255, and a blue sub-pixel gray level Gb=255.

In step 302, the first pixel P1 and the second pixel P2 are converted by utilizing gamma correction according to equation 1 so that gray levels of sub-pixels are converted to first RGB brightness levels of sub-pixels in order to correctly involve backlight intensity in the method 300. The first RGB brightness levels of sub-pixels of P1 and P2 range from 0 to 1. After conversion, for the first pixel P1, the first RGB brightness level of red sub-pixel Vr=1, the first RGB brightness level of green sub-pixel Vg=0, and the first RGB brightness level of blue sub-pixel Vb=0, indicated by P1(1,0,0); for the second pixel P2, the first RGB brightness level of red sub-pixel Vr=1, the first RGB brightness level of green sub-pixel Vg=1, and the first RGB brightness level of blue sub-pixel Vb=1, indicated by P2(1,1,1). The same processes are applied to other pixels 104 in the dynamic backlight sector 102 as are applied to the first pixel P1 and the second pixel P2. The power term in equation 1 may be 2.2 or other values.

$$\left(\frac{Gr,\ Gg,\ \text{or}\ Gb}{255}\right)^{2.2} \qquad \text{Equation 1}$$

In step 304, a saturation level S1=1 of the first pixel P1 is derived by utilizing a maximum first RGB brightness level Vmax=1 and a minimum first RGB brightness level Vmin=0 of P1(1,0,0) according to equation 2. A saturation level S2=0 of the second pixel P2 is derived by utilizing a maximum first RGB brightness level Vmax=1 and a minimum first RGB brightness level Vmin=1 of P2(1,1,1) according to equation 2. The same processes are applied to other pixels in the dynamic backlight sector 102 as are applied to the first pixel P1 and the second pixel P2.

$$\frac{V\max - V\min}{V\max} \qquad \text{Equation 2}$$

Figure 4:
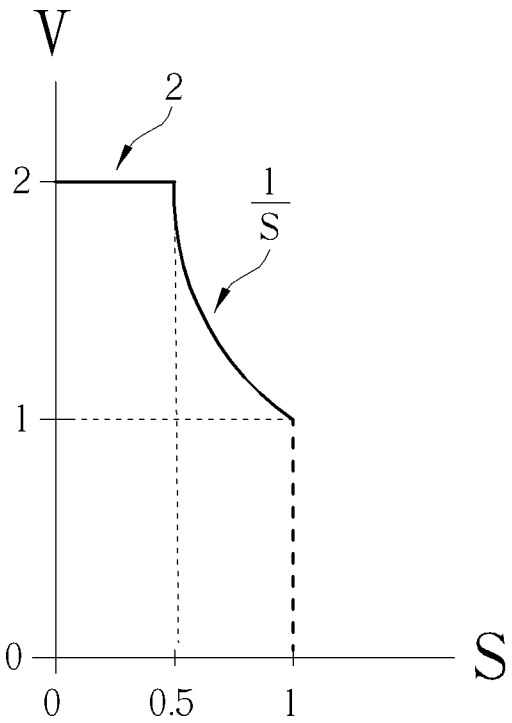
FIG. 4 is a diagram illustrating relationship between a saturation level and a brightness level.

Please refer to FIG. 4 that is a diagram illustrating relationship between a saturation level S and a brightness level V. Horizontal axis of FIG. 4 is the saturation level S and the vertical axis of FIG. 4 is the brightness level V. When the saturation level S is smaller than a threshold value, the saturation level S corresponds to a boundary of the brightness level V different from that of the brightness level V when the saturation level S is not smaller than the threshold value. The threshold value may be 0.5. In FIG. 4, if the saturation level S<0.5, the corresponding boundary of the brightness level V=2; if the saturation level S≥0.5, the corresponding boundary of the brightness level V=1/S. Since the saturation level S1 of P1 is 1, the corresponding boundary of the brightness level V will be 1. In step 306, a mapping ratio $\alpha_1$=1 is derived by dividing the corresponding boundary of the brightness level V of P1, which is 1, by the maximum first RGB brightness level Vmax=1 of P1. Since the saturation level S2 of P2 is 0, the corresponding boundary of the brightness level V will be 2. In step 306, a mapping ratio $\alpha_2$=2 is derived by dividing the corresponding boundary of the brightness level V of P2, which is 2, by the maximum first RGB brightness level Vmax=1 of P2. The same processes are applied to other pixels in the dynamic backlight sector 102 as are applied to the first pixel P1 and the second pixel P2.

The mapping ratios $\alpha$ are coefficients to be multiplied by RGB signals of each pixel 104 respectively in the process of expanding RGB signals to RGBW signals. After deriving the mapping ratios $\alpha$ of the 25 pixels 104 in the dynamic backlight sector 102 according to FIG. 4 and step 306, the minimum mapping ratio $\alpha_{min}$ among the mapping ratios $\alpha$ of the 25 pixels 104 can be derived. The mapping ratio $\alpha$=1 of P1 is used as the minimum mapping ratio $\alpha_{min}$ among the mapping ratios $\alpha$ of the 25 pixels 104 as example in the following steps.

The minimum mapping ratio $\alpha_{min}$ is inversely proportional to ideal BL duty of the dynamic backlight sector 102 in which the 25 pixels 104 are located, that is ideal BL duty=1/$\alpha_{min}$. However, due to backlight diffusion effects among different backlight sectors of light emitting diode (LED) backlight module, a backlight diffusion coefficient $BL_{diffusion}$ is needed to correct $\alpha_{min}$ so that BL duty of each dynamic backlight sector 102 may be better adjusted for the converted RGBW signals to achieve better display quality, otherwise image distortions may appear between dark and bright intersections of display panels, thus practical BL duty<1/$\alpha_{min}$. The backlight diffusion effects will be detailed later.

In step 308, for the first pixel P1, the first RGB brightness level of red sub-pixel Vr is multiplied by $\alpha_{min}$ (1 multiplied by 1), the first RGB brightness level of green sub-pixel Vg is multiplied by $\alpha_{min}$ (0 multiplied by 1), and the first RGB brightness level of blue sub-pixel Vb is multiplied by $\alpha_{min}$ (0 multiplied by 1) to expand RGB signals of P1, so that the second RGB brightness level of red sub-pixel Vr'=1, the second RGB brightness level of green sub-pixel Vg'=0, and the second RGB brightness level of blue sub-pixel Vb'=0, indicated by P1'(1,0,0). For the second pixel P2, the first RGB brightness level of red sub-pixel Vr is multiplied by $\alpha_{min}$ (1 multiplied by 1), the first RGB brightness level of green sub-pixel Vg is multiplied by $\alpha_{min}$ (1 multiplied by 1), and the first RGB brightness level of blue sub-pixel Vb is multiplied by $\alpha_{min}$ (1 multiplied by 1) to expand RGB signals of P2, so that the second RGB brightness level of red sub-pixel Vr'=1, the second RGB brightness level of green sub-pixel Vg'=1, and the second RGB brightness level of blue sub-pixel Vb'=1, indicated by P2' (1,1,1). The same processes are applied to other pixels in the dynamic backlight sector 102 as are applied to the first pixel P1 and the second pixel P2.

In step 310, a predetermined value may be set to 0.5. A minimum second RGB brightness level of P1' (1,0,0), Vmin'=0, may be multiplied by a predetermined value to derive the brightness level of white sub-pixel Wo=0 (0 multiplied by 0.5) of P1, and a minimum second RGB brightness level of P2' (1,1,1), Vmin'=1, may be multiplied by a predetermined value to derive the brightness level of white sub-pixel Wo=0.5 (1 multiplied by 0.5) of P2. The same processes are applied to other pixels in the dynamic backlight sector 102 as are applied to the first pixel P1 and the second pixel P2. In step 310, the minimum second RGB brightness level may otherwise be divided by another predetermined value to derive the brightness level of white sub-pixel Wo, and the another predetermined value may be set to 2.

In step 312, for the first pixel P1, the second RGB brightness level of red sub-pixel Vr' is subtracted by the brightness level of white sub-pixel Wo (1 minus 0), the second RGB brightness level of green sub-pixel Vg' is subtracted by the brightness level of white sub-pixel Wo (0 minus 0), and the second RGB brightness level of blue sub-pixel Vb' is subtracted by the brightness level of white sub-pixel Wo (0 minus 0), so as to derive a RGBW brightness level of red sub-pixel of P1, a RGBW brightness level of green sub-pixel of P1, a RGBW brightness level of blue sub-pixel of P1, and a RGBW brightness level of white sub-pixel of P1, indicated by P1(1, 0,0,0). For the second pixel P2, the second RGB brightness level of red sub-pixel Vr' is subtracted by the brightness level of white sub-pixel Wo (1 minus 0.5), the second RGB brightness level of green sub-pixel Vg' is subtracted by the brightness level of white sub-pixel Wo (1 minus 0.5), and the second RGB brightness level of blue sub-pixel Vb' is subtracted by the brightness level of white sub-pixel Wo (1 minus 0.5), so as to derive a RGBW brightness level of red sub-pixel of P2, a RGBW brightness level of green sub-pixel of P2, a RGBW brightness level of blue sub-pixel of P2, and a RGBW brightness level of white sub-pixel of P2, indicated by P2(0.5, 0.5, 0.5, 0.5). The same processes are applied to other pixels in the dynamic backlight sector 102 as are applied to the first pixel P1 and the second pixel P2.

In step 314, the RGBW brightness levels of sub-pixels of P1 are converted by utilizing inverse gamma correction to generate RGBW gray levels of sub-pixels of P1. The RGBW brightness levels of sub-pixels of P2 are converted by utilizing inverse gamma correction to generate RGBW gray levels of sub-pixels of P2. The same processes are applied to other pixels in the dynamic backlight sector 102 as are applied to the first pixel P1 and the second pixel P2.

Figure 5:
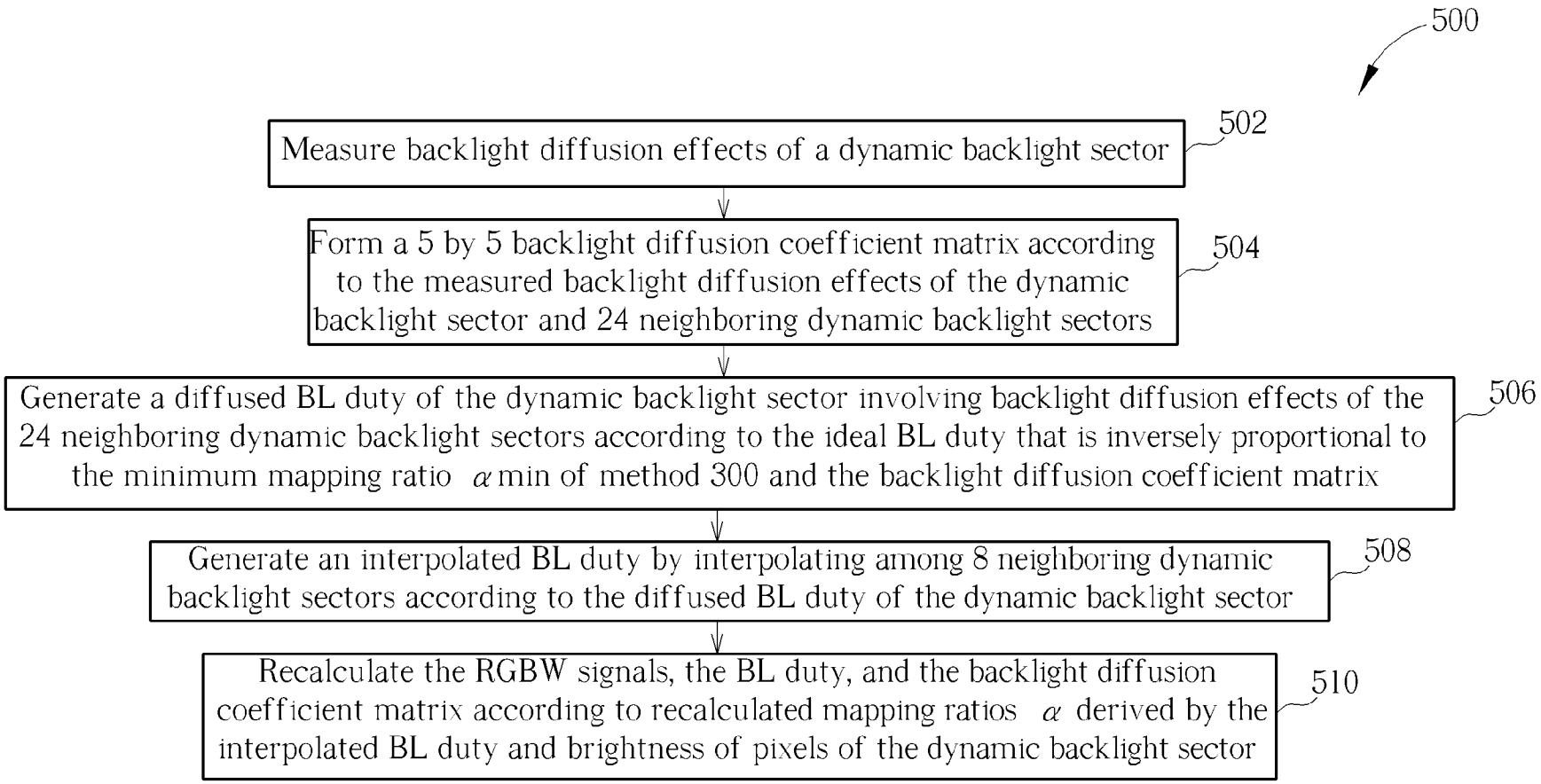
FIG. 5 is a flowchart illustrating a method of correcting the minimum mapping ratio by the backlight diffusion coefficient.
Figure 6:
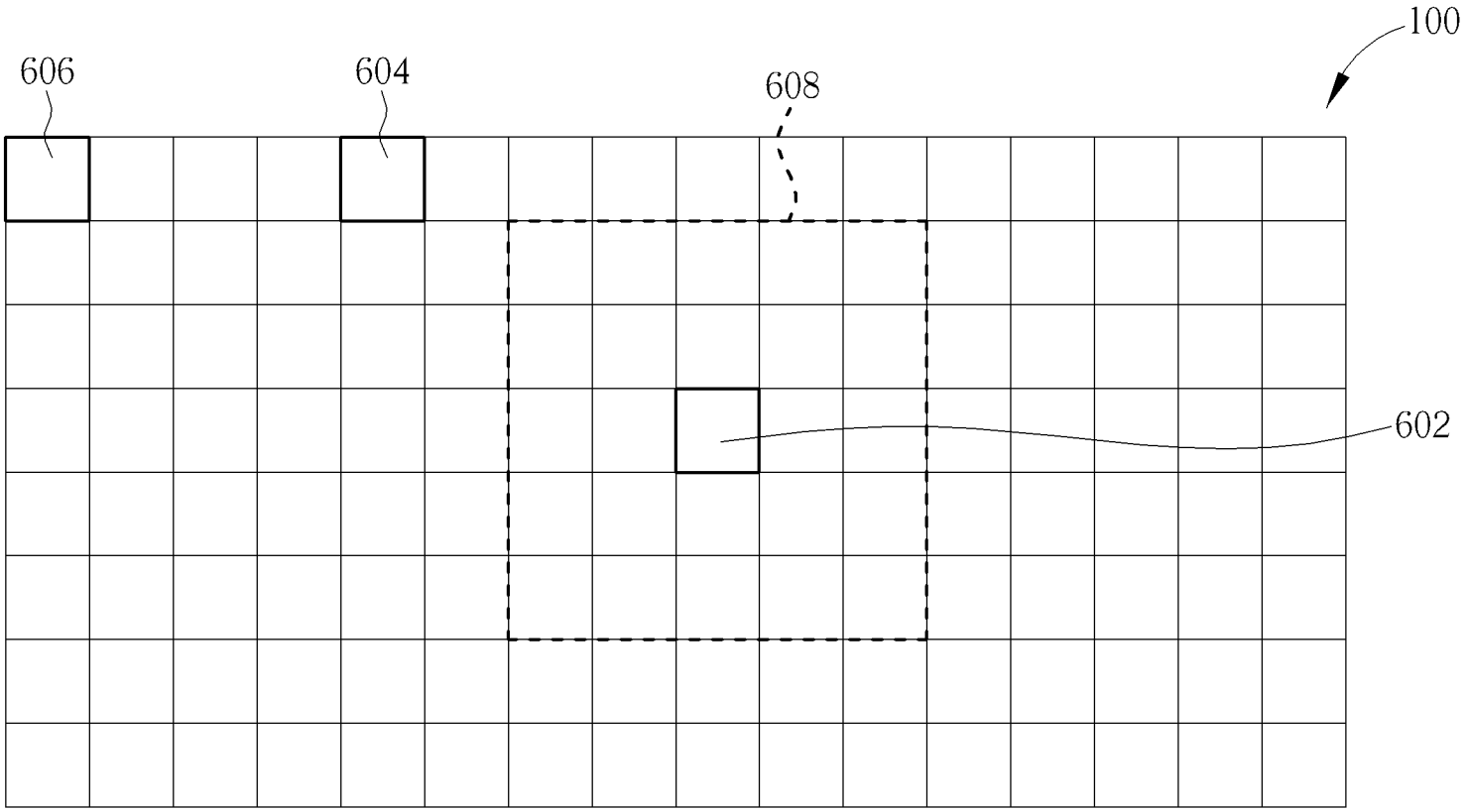
FIG. 6 is a diagram illustrating a display panel having a plurality of dynamic backlight sectors.

Please refer to FIG. 1, FIG. 5, FIG. 6, and table 1. FIG. 5 is a flowchart illustrating a method 500 of correcting the minimum mapping ratio $\alpha_{min}$ by the backlight diffusion coefficient. FIG. 6 is a diagram illustrating a display panel 100 having a plurality of dynamic backlight sectors. Table 1 is an example of a backlight diffusion coefficient matrix. The method 500 may include the following steps.

Step 502: Measure backlight diffusion effects of a dynamic backlight sector 102.

Step 504: Form a 5 by 5 backlight diffusion coefficient matrix according to the measured backlight diffusion effects of the dynamic backlight sector 102 and 24 neighboring dynamic backlight sectors.

Step 506: Generate a diffused BL duty of the dynamic backlight sector 102 involving backlight diffusion effects of the 24 neighboring dynamic backlight sectors according to the ideal BL duty that is inversely proportional to the minimum mapping ratio $\alpha_{min}$ of method 300 and the backlight diffusion coefficient matrix.

Step 508: Generate an interpolated BL duty by interpolating among 8 neighboring dynamic backlight sectors according to the diffused BL duty of the dynamic backlight sector 102.

Step 510: Recalculate the RGBW signals, the BL duty, and the backlight diffusion coefficient matrix according to recalculated mapping ratios $\alpha$ derived by the interpolated BL duty and brightness of pixels of the dynamic backlight sector 102.

Please refer to FIG. 6. In step 502 to step 506, three dynamic backlight sectors, which are center sector 602, boundary sector 604, and corner sector 606, are required to be lit individually for measuring backlight diffusion effects. Brightness of the center sector 602 and brightness of 24 neighboring sectors indicated by dash line 608 are measured after the center sector 602 is lit. Then brightness proportions of center sector 602 to 24 neighboring sectors representing the backlight diffusion effects of the center sector 602 may be derived to form the 5 by 5 backlight diffusion coefficient matrix as in table 1. The center entry of table 1 is proportion of center point of the center sector 602, which is 100%. Brightness diffused to 24 neighboring sector may be derived by multiplying brightness proportions by the ideal BL duty in the method 300. Then backlight diffusion effects among all 128 dynamic backlight sectors 102 according to aforementioned method are calculated to derive actual brightness of all 128 dynamic backlight sectors involving backlight diffusion effects. Backlight diffusion coefficients of the boundary sector 604 and the corner sector 606 may need adjustment because backlight emitting from the boundary sector 604 and the corner sector 606 may be reflected by outside frame of display panel 100 and cause brightness of the boundary sector 604 and the corner sector 606 to be brighter than the center sector 602. The said phenomena are well considered when designing LED backlight modules, thus a distance between outside frames and LED backlight of boundary sector 604 and a distance between outside frames and LED backlight of the corner sector 606 are adjusted to make brightness of the boundary sector 604 and the corner sector 606 to be the same as the center sector 602. Then step 508 to step 510 are performed to derive diffused mapping ratios $\alpha$ involving backlight diffusion effects.

TABLE 1

| | | | | |
|---|---|---|---|---|
| 5.2% | 7.1% | 8.3% | 7.3% | 5.4% |
| 7.6% | 15.5% | 27.0% | 16.8% | 7.9% |
| 9.3% | 29.3% | 100.0% | 32.4% | 10.0% |
| 7.8% | 15.9% | 27.2% | 16.8% | 8.3% |
| 5.0% | 6.7% | 7.8% | 6.9% | 5.2% |

Both image distortion between dark and bright intersections of display panels and segmental discontinuity of image disappeared after RGBW signals of pixels 104 are adjusted by backlight diffusion effects.

The method 300 may convert RGB signals to RGBW signals involving BL duty of each dynamic backlight sector 102 in the conversion, thereby improving on the flaw of images displayed on RGBW LCD panels being darker when the images are single colored, and improving on the flaw of brightness being too bright when RGBW LCD panels display all white images. Thus RGBW display panels utilizing the method of the present invention consume less power and have better image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image processing method comprising:

providing a set of first RGB (red, green, blue) brightness levels of a set of pixels in a display panel having a plurality of sets of pixels and a plurality of dynamic backlight sectors corresponding to the plurality of sets of pixels;

generating a set of saturation levels according to the set of first RGB brightness levels;

generating a set of mapping ratios according to the set of saturation levels and the set of first RGB brightness levels, wherein a mapping ratio of a pixel of the set of pixels is generated by dividing a predetermined value by a maximum first RGB brightness level of first RGB brightness levels of the pixel when the saturation of the pixel is smaller than a threshold value;

generating a set of second RGB brightness levels according to the set of first RGB brightness levels and a minimum mapping ratio of the set of mapping ratios;

generating a set of brightness levels of white sub-pixels, each brightness level of white sub-pixel being generated according to a minimum second RGB brightness level of second RGB brightness levels of each pixel;

generating a set of RGBW (red, green, blue, white) brightness levels according to the set of second RGB brightness levels and the set of brightness levels of white sub-pixels;

converting the set of RGBW brightness levels to generate a set of RGBW gray levels of the set of pixels;

measuring backlight diffusion effects of a dynamic backlight sector;

forming a backlight diffusion coefficient matrix according to the measured backlight diffusion effects of the dynamic backlight sector and neighboring dynamic backlight sectors;

generating a diffused backlight duty of the dynamic backlight sector involving the backlight diffusion effects of the neighboring dynamic backlight sectors according to an ideal backlight duty that is inversely proportional to the minimum mapping ratio and the backlight diffusion coefficient matrix;

generating an interpolated backlight duty by interpolating among the neighboring dynamic backlight sectors according to the diffused backlight duty of the dynamic backlight sector; and generating RGBW signals according to recalculated mapping ratios derived by the interpolated backlight duty and brightness of pixels of the dynamic backlight sector.

2. The method of claim 1 further comprising:

generating a backlight duty cycle of the set of pixels according to the minimum mapping ratio of the set of mapping ratios.

3. The method of claim 1 further comprising:

generating a backlight duty cycle of the set of pixels according to the minimum mapping ratio of the set of mapping ratios and backlight diffusion effects of backlight emitting from other sets of pixels in the display panel.

4. The method of claim 1 wherein the display panel comprises a plurality of sets of pixels and a plurality of backlight sectors corresponding to the plurality of sets of pixels, the method further comprising:

generating a first backlight duty cycle of a backlight sector corresponding to the set of pixels according to the minimum mapping ratio of the set of mapping ratios;

forming a backlight diffusion coefficient matrix according to measurement of backlight emitting from the plurality of backlight sectors;

generating a second backlight duty cycle of the backlight sector corresponding to the set of pixels according to the first backlight duty cycle and the backlight diffusion coefficient matrix; and generating a backlight duty cycle of the backlight sector corresponding to the set of pixels by interpolating among neighboring backlight sectors according to the second backlight duty cycle of the backlight sector.

5. The method of claim 1 wherein providing the set of first RGB brightness levels of the set of pixels in the display panel is performed by converting a set of RGB gray levels of the set of pixels to generate the set of first RGB brightness levels.

6. The method of claim 5 wherein converting the set of RGB gray levels to generate the set of first RGB brightness levels is converting the set of RGB gray levels to generate the first set of RGB brightness levels utilizing gamma correction.

7. The method of claim 1 wherein generating the set of saturation levels according to the set of first RGB brightness levels is generating the set of saturation levels, each saturation level being generated according to a ratio of difference between a maximum first RGB brightness level and a minimum first RGB brightness level to the maximum first RGB brightness level of first RGB brightness levels of each pixel.

8. The method of claim 1 wherein generating the set of mapping ratios according to the set of saturation levels and the set of first RGB brightness levels comprises:

generating a mapping ratio of a pixel of the set of pixels by dividing a reciprocal of the saturation level of the pixel by a maximum first RGB brightness level of first RGB brightness levels of the pixel when the saturation of the pixel is bigger than the threshold value.

9. The method of claim 1 wherein generating the set of second RGB brightness levels according to the set of first RGB brightness levels and the minimum mapping ratio of the set of mapping ratios is generating the set of second RGB brightness levels by multiplying the set of first RGB brightness levels by the minimum mapping ratio.

10. The method of claim 1 wherein generating the set of brightness levels of white sub-pixels comprises generating each brightness level of white sub-pixel by dividing the minimum second RGB brightness level of the second RGB brightness levels of each pixel by another predetermined value.

11. The method of claim 1 wherein generating the set of RGBW brightness levels according to the set of second RGB brightness levels and the set of brightness levels of white sub-pixels comprises subtracting the second RGB brightness levels of each pixel by brightness level of white sub-pixel of each pixel.

12. The method of claim 1 wherein converting the set of RGBW brightness levels to generate the set of RGBW gray levels is converting the set of RGBW brightness levels to generate the set of RGBW gray levels by utilizing inverse gamma correction.

13. The method of claim 1 further comprising:

forming a backlight diffusion coefficient matrix according to the measured backlight diffusion effects of the dynamic backlight sector and 24 nearest neighboring dynamic backlight sectors; and generating an interpolated backlight duty by interpolating among the nearest 8 of the 24 nearest neighboring dynamic backlight sectors according to the diffused backlight duty of the dynamic backlight sector.

14. An image processing method in a display panel having a plurality of sets of pixels and a plurality of dynamic backlight sectors corresponding to the plurality of sets of pixels, the method comprising;

generating a set of saturation levels according to a set of RGB brightness levels;

generating a set of mapping ratios according to the set of saturation levels and the set of RGB brightness levels, wherein generating a mapping ratio of a pixel of the set of pixels by dividing a reciprocal of the saturation level of the pixel by a maximum first RGB brightness level of first RGB brightness levels of the pixel when the saturation of the pixel is bigger than a threshold value;

measuring backlight diffusion effects of a dynamic backlight sector;

forming a backlight diffusion coefficient matrix according to the measured backlight diffusion effects of the dynamic backlight sector and neighboring dynamic backlight sectors;

generating a diffused backlight duty of the dynamic backlight sector involving the backlight diffusion effects of the neighboring dynamic backlight sectors according to an ideal backlight duty that is inversely proportional to the minimum mapping ratio and the backlight diffusion coefficient matrix;

generating an interpolated backlight duty by interpolating among the neighboring dynamic backlight sectors according to the diffused backlight duty of the dynamic backlight sector; and generating RGBW signals according to recalculated mapping ratios derived by the interpolated backlight duty and brightness of pixels of the dynamic backlight sector.

15. The method of claim 14 further comprising:

forming a backlight diffusion coefficient matrix according to the measured backlight diffusion effects of the dynamic backlight sector and 24 nearest neighboring dynamic backlight sectors; and generating an interpolated backlight duty by interpolating among the nearest 8 of the 24 nearest neighboring dynamic backlight sectors according to the diffused backlight duty of the dynamic backlight sector.

16. The method of claim 14 wherein generating the set of saturation levels according to the set of RGB brightness levels is generating the set of saturation levels, each saturation level being generated according to a ratio of difference between a maximum RGB brightness level and a minimum RGB brightness level to the maximum RGB brightness level of RGB brightness levels of each pixel.

17. The method of claim 14 wherein generating the set of mapping ratios according to the set of saturation levels and the set of RGB brightness levels comprises generating a mapping ratio of a pixel of a set of pixels of the plurality of sets of pixels by dividing another predetermined value by a maximum RGB brightness level of RGB brightness levels of the pixel when the saturation of the pixel is smaller than the threshold value.

* * * * *